United States Patent [19]

Renggli et al.

[11] Patent Number: 4,625,348

[45] Date of Patent: Dec. 2, 1986

[54] APPARATUS FOR ADJUSTING THE HEAD OR FOOT SECTION OF THE RESTING SURFACE OF A BED

[75] Inventors: Werner Renggli, Winterthur; Daniel Kung, Kollbrunn, both of Switzerland

[73] Assignee: Urs Widmer, Switzerland

[21] Appl. No.: 690,691

[22] Filed: Jan. 11, 1985

[30] Foreign Application Priority Data

Jan. 12, 1984 [DE] Fed. Rep. of Germany ..... 3400804

[51] Int. Cl.[4] ..... A61G 7/06; A47C 20/04

[52] U.S. Cl. ..... 5/71; 5/80; 5/433; 5/508

[58] Field of Search ..... 5/433, 71, 70, 72, 80, 5/453, 67, 68, 69, 66, 60, 508

[56] References Cited

U.S. PATENT DOCUMENTS

| | | | |
|---|---|---|---|
| 2,769,182 | 11/1966 | Nunlist | 5/72 |
| 3,392,412 | 7/1968 | Aymar | 5/433 |
| 3,392,723 | 7/1968 | Calvin | 5/60 |
| 3,667,075 | 6/1972 | Ballard et al. | 5/456 |
| 3,781,928 | 1/1974 | Swallert | 5/433 |
| 4,309,783 | 1/1982 | Cammack et al. | 5/453 |
| 4,458,370 | 7/1984 | Fickler | 5/71 |
| 4,527,298 | 7/1985 | Moulton | 5/453 |

FOREIGN PATENT DOCUMENTS

| | | | |
|---|---|---|---|
| 526427 | 6/1956 | Canada | 5/68 |
| 2852323 | 12/1979 | Fed. Rep. of Germany . | |
| 2077859 | 12/1981 | United Kingdom | 5/67 |
| 2102282 | 2/1983 | United Kingdom | 5/433 |

*Primary Examiner*—Alexander Grosz

*Attorney, Agent, or Firm*—Thomas W. Speckman

[57] ABSTRACT

An apparatus for adjusting the head and the foot section of the resting surface of a bed by means of a bellows or a plurality of bellows which are expanded by compressed air and contracted by expelling the compressed air. Due to the particular construction of the compressed air unit and its positioning in a receiving space enclosed by a base plate and an adjusting plate, a self-contained appliance unit is provided which is suitable for use with any bed.

12 Claims, 2 Drawing Figures

APPARATUS FOR ADJUSTING THE HEAD OR FOOT SECTION OF THE RESTING SURFACE OF A BED

BACKGROUND OF THE INVENTION

1. Field of the Invention

The present invention relates to an apparatus for adjusting the head and foot sections of the resting surface of a bed by means of a bellows or a plurality of bellows being expanded by compressed air and contracted by expelling the compressed air.

2. Description of the Prior Art

A device of this general type is disclosed by German Patent Publication DE-OS No. 28 52 323. In this prior device, the bellows, or pair of bellows, is integrated in the bedframe and secured to parts of it. Thus, the device may be utilized only with beds which were originally fitted with bellows, or a plurality of bellows, during manufacture. To subsequently equip beds having an adjustable bedframe or beds in which the mattress or mattress sections are placed on a rigid, non-adjustable foundation deck is impossible once the beds have left the manufacturing plant.

SUMMARY OF THE INVENTION

It is an object of the present invention to provide an apparatus for the head and foot sections of the surface of a bed which is a self-contained unit and is capable of being utilized with any type of bed without difficult installation.

This is accomplished according to the present invention in that the compressed air generator is a unitary structure comprising an electric motor and a pump coupled to the motor, that an electric switch having at least three switching positions operates in its first switching position to deactivate the electric motor and to close the conduit between the bellows or plurality of bellows and the compressed air outlet of the pump, that the electric switch in its second switching position operates to activate the electric motor and to open the conduit between the compressed air outlet of the pump and the bellows or plurality of bellows, that the electric switch in its third switching position operates to establish communication between the bellows or plurality of bellows and the atmosphere, that the unit comprising the compressed air generator and the lower face of the bellows or plurality of bellows is positioned on a rectangular base plate, that the upper face of the bellows or plurality of bellows is secured to a rectangular adjusting plate, and that the bellows or plurality of bellows as it expands raises the adjusting plate angularly from a position approximately parallel to the base plate, as viewed with respect to a common edge of base and adjusting plate, to an angular position of predetermined inclination.

The apparatus according to the present invention may be fabricated as a self-contained appliance unit and is ready for placement between the mattress and the mattress support structure. The apparatus is capable of adjusting the head section as well as the foot section of the mattress; it merely needs to be turned by 180°. Since the compressed air generator comprising the power operated electric motor and the pump coupled to it is integrally built into the apparatus, the self-contained appliance is ready to operate merely by plugging it into any electrical outlet. No installation is required to connect the appliance to the bedframe, the mattress support or the mattress. Furthermore, the electrical components are protected inside the appliance so that no special safety measures need to be taken when using the appliance.

The operational noise level of the apparatus may be kept low according to one embodiment in that the power operated electric motor is an alternating current motor, that the pump is in the form of a rotary vane pump, a turbine or the like, and that the electric motor and the pump are mounted in a housing in a noise deadening manner, or the pump is provided with a sound absorber. Adjusting the speed of the electric motor to the optimum speed of the pump is conveniently achieved by gears disposed between the electric motor and the pump.

One embodiment has been found particularly advantageous in which the angle between the base plate and the adjusting plate is adjustable with respect to one of their edges. The apparatus may be stabilized by hingedly joining the base to the adjusting plate along one of their corresponding edges.

In order for the compressed air generator to be conveniently housed within the apparatus, according to one embodiment the base plate is provided with side walls so as to be box-shaped, and the height of the side walls is equal to or greater than the height of the compressed air generator unit as a whole. In the initial position, the receiving space thus formed may be completely closed by the adjusting plate which is hinged along one of its longitudinal edges to the upper edge of the corresponding wall of the base.

The receiving space for the compressed air generator may also be provided, according to one embodiment, in that both the base and the adjusting plate have right-angled side walls facing each other to form a box-shaped space, that the base and the adjusting plate are hingedly joined along the edges of corresponding side walls facing each other, and that in the initial position the side walls of the base and the adjusting plate combine to enclose a space the height of which is equal to or slightly greater than the height of the compressed air generator.

For ease of access, the compressed air generator is preferably positioned in the area of the side wall of the base which is opposite the side wall to which the adjusting plate is hinged.

To establish an operative connection between the pump and the bellows or plurality of bellows, one embodiment provides that in the second switching position of the electric switch a valve or a plurality of valves is opened to connect the compressed air outlet from the pump to the compressed air pipeline leading to the bellows.

Preferably, the valve or plurality of valves is in the form of a check valve, with the direction of flow being from the compressed air outlet of the pump to the bellows or plurality of bellows.

The release of compressed air from the bellows or plurality of bellows is accomplished, according to one embodiment, in that in the third switching position of the electric switch another valve or plurality of additional valves is opened whereby communication is established between the compressed air line of the bellows or plurality of bellows and a conduit to the atmosphere. To this end, the additional valve or plurality of valves according to the present invention is in the form of an electromagnetically operable valve controlled by the electric switch in its third switching position.

The number of valves required may be kept to a minimum when the compressed air outlet of the pump is connected to the bellows or plurality of bellows by way of the check valve in the flow direction and in the passageway of a T-section, and the electromagnetically controlled valve is connected to the branch of the T-section.

Air expelled by the bellows or plurality of bellows may be utilized if the outlet opening of the electromagnetically operated valve is connected to the branch of another T-section, the passageway of which connecting a filter disposed in advance of the pump to the intake opening of the pump.

Return of the adjusting plate to its initial position may be facilitated by a torsion spring connecting the adjusting plate to the base plate.

BRIEF DESCRIPTION OF THE DRAWINGS

The invention will be described in further detail with reference to one embodiment illustrated in the drawings, in which.

DESCRIPTION OF THE PREFERRED EMBODIMENTS

Figure 1:
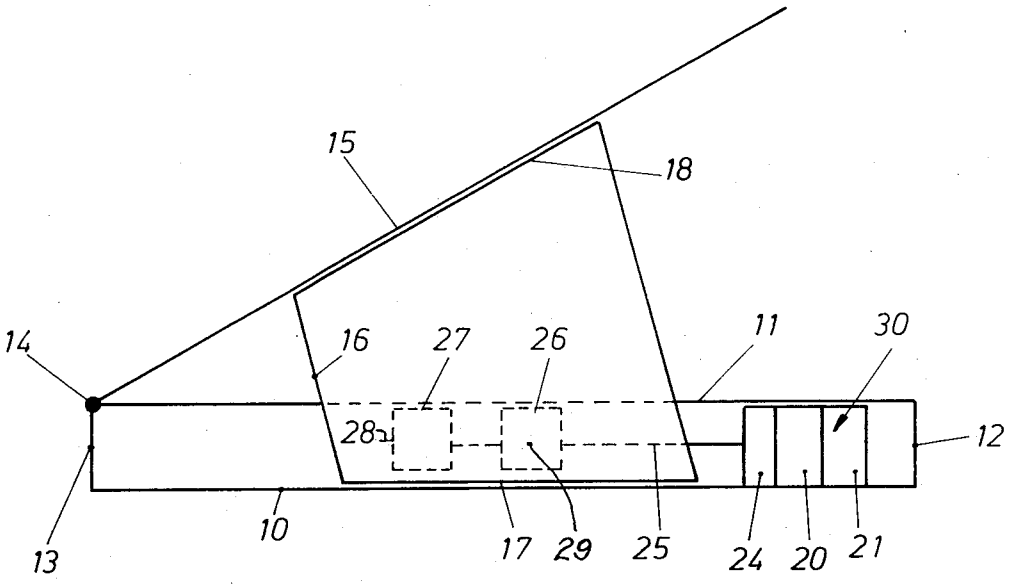
FIG. 1 is a side view of one embodiment of the apparatus of this invention.
Figure 2:
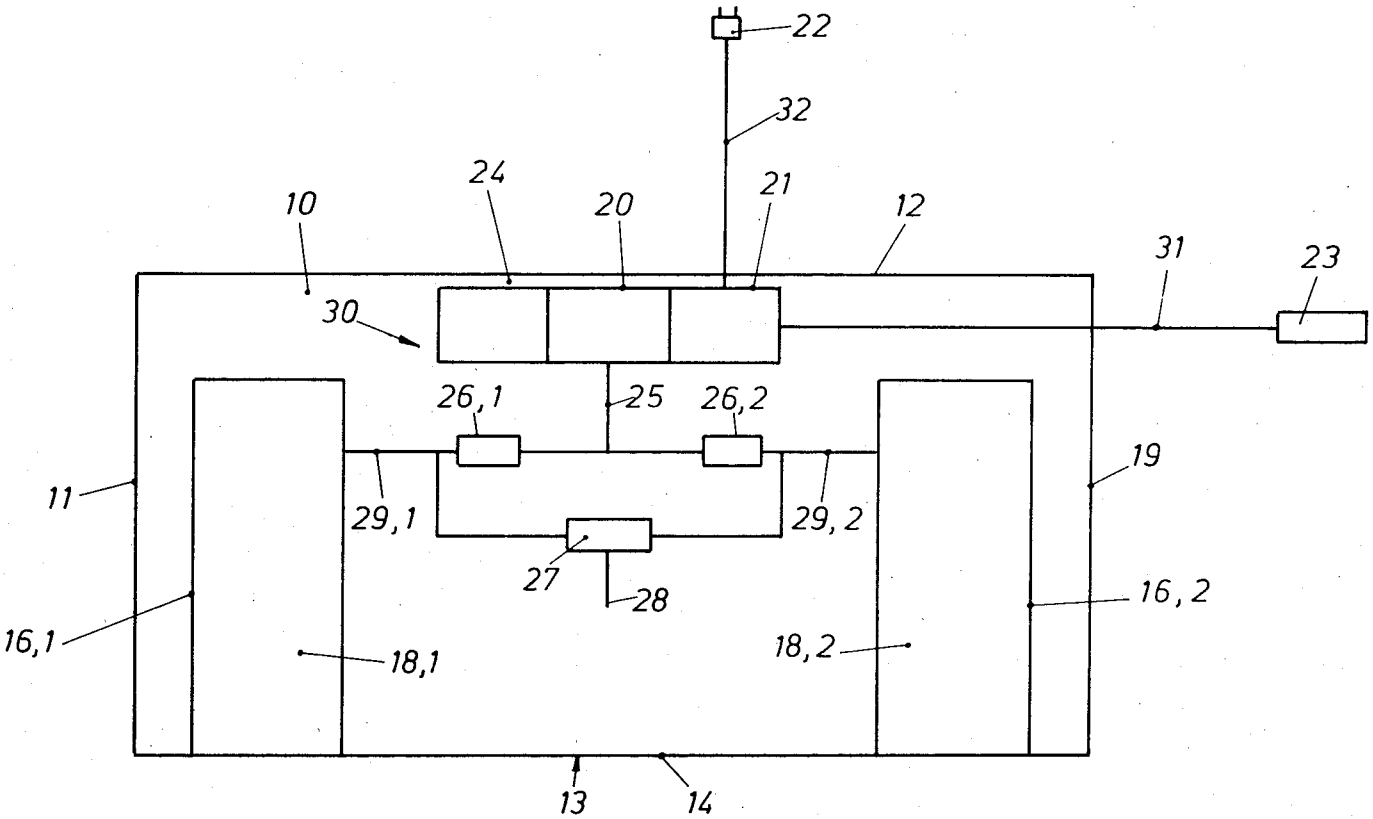
FIG. 2 is a top plan view of another embodiment of the apparatus of this invention with the adjusting plate removed.

The apparatus comprises a rectangular box-shaped base 10 with side walls 11, 12, 13 and 19 defining a receiving space for the compressed air generator 30. Adjusting plate 15 is joined to the upper edge of longitudinal side wall 13 by means of hinge 14. As shown in FIG. 1, bellows 16 is secured on base 10. Similarly, as shown in FIG. 2, a plurality of bellows 16.1, 16.2 is secured on their undersides, not shown, to base 10. The underside of bellows 16 is designated 17. The upper face 18 of bellows 16, or upper faces 18.1, 18.2 of pair of bellows 16.1, 16.2, respectively, are fixedly joined to the underside of adjusting plate 15. Bellows 16, or the pair of bellows 16.1, 16.2, respectively, operate so that, as they expand, adjusting plate 15 is moved from its initial position, in which it rests on box-shaped base 10, to a predetermined angular position which may have an inclination of 50°, for example.

Both base 10 and adjusting plate 15 may be box-shaped and their open ends may face each other. Also in this case, the receiving space is made to conform to the structural height of air compressor unit 30. Base 10 and adjusting plate 15 are hingedly connected to each other along the upper edges of corresponding side walls facing each other.

Electric motor 21 has cord 32 with plug 22 for connection to a power outlet. Three-position switch 23 is connected to unit 30 by cord 31. In an initial position comprising a first switching position, switch 23 is actuated to turn off electric motor 21. In this position, all valves 26, 26.1, 26.2 and 27 are closed. Valve 26 closes conduit 29 leading from compressed air outlet 25 of the pump 20 to bellows 16. Pump 20 is coupled to electric motor 21. If two bellows 16.1, 16.2 are provided, valves 26.1, 26.2 close conduits 29.1, 29.2 leading to bellows 16.1, 16.2. In this switching position, the pressure built up in bellows 16, or pair of bellows 16.1, 16.2, respectively, is maintained because valve 27, or additional valves, are closed to separate conduit 29, or the conduits 29.1, 29.2, respectively, from a conduit to atmosphere 28.

Turning switch 23 to its first operative position, the second switching position, activates electric motor 21 and opens valves 26, 26.1 and 26.2. Pump 20 generates compressed air which is delivered through open valves 26, 26.1 and 26.2 to bellows 16, 16.1 and 16.2, building up pressure in the bellows to raise adjusting plate 15 and to adjust it to the desired angular position. Turning switch 23 back to its initial position, the first switching position, causes conduit 29, 29.1 and 29.2 to close due to deenergization of valves 26, 26.1 and 26.2, and the pressure accumulated in bellows 16, 16.1 and 16.2 is maintained.

Valves 26, 26.1 and 26.2 may be in the form of check valves which are opened with compressed air delivered by pump 20 to permit flow in the direction of bellows 16, 16.1 and 16.2. Valves 26, 26.1 and 26.2 may also be in the form of electromagnetically operated valves controlled by switch 23 in its first switching position.

Moving switch 23 into its second operative position, the third switching position, leaves electric motor 21 deactivated and valves 26, 26.1 and 26.2 closed, whereas the electromagnetic valve 27 is energized by a contact of switch 23 to establish connection between conduit 29 and conduit to the atmosphere 28, or conduits 29.1, 29.2 and conduit to the atmosphere 28, respectively. Compressed air is free to escape from bellows 16, 16.1 and 16.2 and adjusting plate 15 may be lowered back toward base 10. This movement may be initiated merely by the load placed on adjusting plate 15. Adjusting plate 15 may also be connected to base 10 by a torsion spring to faciliate the return of the adjusting plate to its initial position.

When the desired angle of inclination between adjusting plate 15 and base 10 has been reached, switch 23 is turned back to its initial position, the first switching position. Valve 27, no longer energized, closes conduit to the atmosphere 28 and the remaining pressure in bellows 16, 16.1 and 16.2 is maintained.

Valves 26 and 27 may be combined; it is merely important to control the desired temporary opening and closing of the passages.

It has been found to be particularly useful if compressed air outlet 25 of pump 20 is connected to bellows 16, or pair of bellows 16.1, 16.2, by a check valve such as valve 26 permitting flow in the direction of the bellows and the passageway of a T-section. This type of connection is automatically established in the first operative position, the second switch position of switch 23. Connected to the branch of the T is electromagnetically operable valve 27 which is energized by a contact of the switch 23 when the switch 23 is in its second operative, or third switch position. The outlet of valve 27 may be connected to the branch of another T-section, the passageway of which extends between the intake orifice of the pump 20 and a filter in front of the pump. The air released by bellows 16, or plurality of bellows 16.1, 16.2, may then be used to clean the filter.

Pump 20 may be provided with sound absorber 24.

We claim:

1. A self contained, portable, unitary apparatus for adjusting the head and foot sections of the resting surface of a bed by means of at least one bellows being expanded by compressed air and contracted by expelling the compressed air, characterized in that compressed air generator (30) is a unitary structure comprising an electric motor (21) and a pump (20) coupled to said motor; that an electric switch (23) has three switch positions and operates in its first switch position to deactivate said electric motor (21) and to close a conduit (29) between said at least one bellows (16) and a compressed air outlet (25) of said pump (20), said electric switch (23) in its second switch position activates said electric motor (21) and opens said conduit (29) between said compressed air outlet (25) of said pump (20) and said at least one bellows (16), said electric switch (23) in its third switch position establishes communication between said at least one bellows (16) and a conduit to the atmosphere (28); that said compressed air generator (30) and the underside (17) of said at least one bellows (16) is secured to a base plate (10), said base plate (10) having side walls (11, 12, 13, 19) forming a box-shaped base, the height of said side walls being at least as large as the height of said compressed air generator (30); that the upper face (18) of said at least one bellows (16) is secured to an adjusting plate (15), said box-shaped base and said adjusting plate (15) being joined by hinges (14), said base (10) and said adjusting plate (15) combining in an initial position to enclose a space, the height of which is at least as large as the height of said compressed air generator (30); that said at least one bellows (16) as it expands, moves said adjusting plate (15) from a position substantially parallel to said base plate (10) as viewed with repect to a common edge of said base (10) and said adjusting plate (15), to a predetermined angular position within the range of 0° to 50° inclined from said common edge; and that said compressed air generator (30) is positioned in the area of a side wall (12) of said base which is opposite said hinges joining said box-shaped base and said adjusting plate (15).

2. Apparatus according to claim 1, characterized in that said electric motor (21) is an alternating current motor, and that said pump (20) comprises a rotary vane pump.

3. Apparatus according to claim 1, characterized in that said electric motor (21) is an alternating current motor, and that said pump (20) comprises a turbine.

4. Apparatus according to claim 1, characterized in that said electric motor (21) and said pump (20) are disposed in a housing in a noise reducing manner.

5. Apparatus according to claim 1, characterized in that said pump (20) is provided with sound absorber (24).

6. Apparatus according to claim 1, characterized in that the inclination of said adjusting plate (15) with respect to said base (10) is adjustable with respect to one of their corresponding edges.

7. Apparatus according to claim 1, characterized in that said adjusting plate (15) is hinged along one of its edges to the upper edge of one said side wall (13) of said base (10).

8. Apparatus according to claim 1, characterized in that in said second switch position of said switch (23), at least one valve (26) is opened to connect said compressed air outlet (25) of said pump (20) to at least one compressed air conduit (29) leading to said at least one bellows (16).

9. Apparatus according to claim 8, characterized in that said at least one valve (26) is in the form of a check valve with the direction of flow being from said compressed air outlet (25) of said pump (20) to said at least one bellows (16).

10. Apparatus according to claim 1, characterized in that in said third switch position of said switch (23) at least one valve (27) is opened to establish communication between at least one compressed air conduit (29) of said at least one bellows (16) and a conduit to the atmosphere (28).

11. Apparatus according to claim 10, characterized in that said at least one valve (27) is in the form of an electromagnetically operable valve operated by said switch (23) in its third switch position.

12. Apparatus according to claim 11, characterized in that said compressed air outlet (25) of said pump (20) is connected to said at least one bellows (16) by way of a check valve (26) in the flow direction and the passageway of a T-section, and that said electromagnetically operable valve (27) is connected to the branch of said T-section.

* * * * *